US012337882B2

(12) United States Patent
Struwig et al.

(10) Patent No.: US 12,337,882 B2
(45) Date of Patent: Jun. 24, 2025

(54) DEVICE, SYSTEM AND METHOD FOR MONITORING CONDITIONS ON A RAILWAY TRACK

(71) Applicant: HISWAY LABS (PTY) LTD, Somerset West (ZA)

(72) Inventors: Franz Antony Struwig, Somerset West (ZA); Christian Kunneke, Somerset West (ZA)

(73) Assignee: HISWAY LABS (PTY) LTD, Somerset West (ZA)

( * ) Notice: Subject to any disclaimer, the term of this patent is extended or adjusted under 35 U.S.C. 154(b) by 817 days.

(21) Appl. No.: 17/548,199

(22) Filed: Dec. 10, 2021

(65) Prior Publication Data

US 2022/0111878 A1 Apr. 14, 2022

Related U.S. Application Data

(63) Continuation-in-part of application No. PCT/IB2020/055452, filed on Jun. 10, 2020.

(30) Foreign Application Priority Data

Jun. 10, 2019 (NL) ..... 1043288

(51) Int. Cl.
*B61L 23/04* (2006.01)
*B61L 1/18* (2006.01)
*B61L 23/16* (2006.01)

(52) U.S. Cl.
CPC ..... *B61L 23/042* (2013.01); *B61L 1/187* (2013.01); *B61L 23/044* (2013.01);
(Continued)

(58) Field of Classification Search
CPC ..... B61L 1/187; B61L 23/042; B61L 23/044; B61L 23/045; B61L 23/047; B61L 23/048; B61L 23/166; B61L 27/53; B61L 25/021
See application file for complete search history.

(56) References Cited

U.S. PATENT DOCUMENTS 3,850,390 A * 11/1974 Geiger ..... B61L 1/187 246/34 CT
5,680,054 A * 10/1997 Gauthier ..... B61L 23/044 324/705

(Continued)

FOREIGN PATENT DOCUMENTS

DE 102013219763 A1 8/2014
EP 3135555 A1 * 3/2017 ..... B61K 9/08
WO 2006/065730 A2 6/2006

OTHER PUBLICATIONS

"Constant warning time concept development for motorist warning at grade crossings", Final Report for U.S. Department of Transportation, by Systems Technology Laboratory, Inc. (1981).

(Continued)

*Primary Examiner* — Zachary L Kuhfuss
*Assistant Examiner* — Cheng Lin
(74) *Attorney, Agent, or Firm* — Merchant & Gould P.C.

(57) ABSTRACT

A device 10 for a track bound monitoring system for monitoring conditions on a railway track 28 comprising a first rail 26 and a second rail 30 comprises a signal generation unit 12 having an output 13. The signal generation unit is configured to generate an electrical monitoring signal having a monitoring signal characteristic. The output is connectable to at least one of the first rail and the second rail. A sensing unit 16 has an input 17 which is connectable to at least one of the rails. A controller 20 is connected to the generation unit and the sensing unit and is configured to (Continued)

cause the generation unit to generate the monitoring signal which propagates in the first rail and to receive from the sensing unit a return signal. The return signal is derived from the monitoring signal and has a return signal characteristic. The controller is configured to utilize a time difference between the monitoring signal characteristic and the return signal characteristic to monitor conditions on the railway track.

23 Claims, 11 Drawing Sheets

(52) U.S. Cl.
CPC ..... *B61L 23/048* (2013.01); *B61L 23/166* (2013.01); *B61L 23/045* (2013.01)

(56) References Cited

U.S. PATENT DOCUMENTS

| | | | | |
|---|---|---|---|---|
| 9,889,869 | B2 * | 2/2018 | Kull | B61L 27/53 |
| 10,384,699 | B2 * | 8/2019 | Gokmen | B61L 23/044 |
| 10,513,279 | B2 * | 12/2019 | Mulligan | B61L 27/53 |
| 2005/0076716 | A1 * | 4/2005 | Turner | B61L 23/044 73/579 |
| 2008/0105791 | A1 * | 5/2008 | Karg | B61L 23/044 246/120 |
| 2015/0367872 | A1 * | 12/2015 | Plotnikov | B61L 3/18 246/121 |

OTHER PUBLICATIONS

International Search Report and Written Opinion for PCT/IB2020/055452 (Jul. 28, 2020).

* cited by examiner

DEVICE, SYSTEM AND METHOD FOR MONITORING CONDITIONS ON A RAILWAY TRACK

This application is a continuation-in-part of PCT International Application No. PCT/IB2020/055452, filed Jun. 10, 2020, which claims benefit of priority to Patent Application No. 1043288, filed Jun. 10, 2019 in the Netherlands, and which applications are incorporated herein by reference. To the extent appropriate, a claim of priority is made to each of the above-disclosed applications.

INTRODUCTION AND BACKGROUND

This invention relates to a device, a system and a method of monitoring railway track conditions. More particularly, the invention relates to a track-bound device, system and method.

A railway or railroad track is a structure comprising first and second elongate rails, railroad ties, also known as sleepers, fasteners for the rails to the sleepers and ballast. The railway track may comprise a plurality of longitudinally immediately adjacent blocks, which may also be referred to as sections. Some railways are electrified causing additional traction return cables to be connected to at least one of the rails, after which the affected rail is called a "traction return rail".

Conditions that may need to be monitored on a railway track include: occupancy of a block by a railway vehicle, that is the presence or absence of a railway vehicle in the block; position of the railway vehicle; speed and direction of travel of the railway vehicle; buckling of the rails; possible cuts or breaks in the rails; ballast condition and in some cases the position of a railway turnout.

Various railway vehicle detection systems are known. These systems may be divided into two groups, namely vehicle bound systems and track-bound systems. The track-bound systems include track circuits and axle counters.

Track circuits typically require a first power source at a first (transmission) end of a track section and a second power source at a second (receiving) end of the track section. Conventional track circuits' track sections are separated by an electrical isolator installed on the rail, called a block joint. The block joint may be provided in one rail only, alternatively in both rails, typically opposite one another. The power source at the first end of the track section is connected to both rails and the power source at the second end is connected to a detection device, conventionally comprising a relay. The presence of a wheelset of a train will cause a short circuit on the track section on which a track circuit is installed. The short circuit will cause the electrical supply to the relay to be interrupted, causing the relay contacts to open indicating the presence of a railway vehicle. Another type of track circuit called "Jointless Track Circuits" transmits a modulated electrical current signal on each track using a transmitter and receiver pair installed at opposite ends of the track section, while monitoring which electrical current signals can be detected on each track at the receiving end of the track section. The presence of a railway vehicle is detected when both signals are present at the second/receiving end of both tracks due to the temporary short circuit introduced by the rail vehicle axle. Track circuits usually require cables at both the first and second ends of the track section, the cables are visually exposed and therefore susceptible to theft and vandalism. Normally expensive hardware is required and the length of track section which can be monitored, is limited. Conventional track circuits can detect only non-compression track breaks on non-traction return tracks, thus it can detect between 40% and 60% of cut tracks. This is due to electrical traction cables providing an alternative path for a signal applied to the rail. Furthermore, the known track circuits are energy intensive and cannot provide data regarding the train's travelling direction, immediate location, speed, length or decoupled trains within a track section, or detect cut traction return tracks or an indication regarding the ballast conditions in that track section being monitored.

Axle counters determine the number of wheelsets entering and leaving a track section. Axle counters require a first sensor and second sensor to be installed at the first and second ends of the track section to be monitored, with the sensors configured to work together. The sensors of an axle counter may comprise magnetic, ultrasonic, visual, or audio sensing devices. Axle counters determine the occupancy of a track section by comparing the number of wheelsets which entered a track section with the number of wheelsets which left the section. If the number of wheelsets that have entered a track section is more than the number of wheelsets that have left a track section, then the track section is indicated as occupied. Axle counters have the following disadvantages. Unoccupied track sections must manually be verified after power up, cables are required at both the first and second ends of the track section, parts of the cables are visually exposed and therefore susceptible to theft and vandalism. These counters also cannot provide data regarding the train's immediate location before or after passing the sensor or train breaks within a track section, data relating to ballast conditions of the track sections and cannot determine the presence of cuts in railway tracks.

Electrical time domain reflectometry is a term for a phenomenon where an electrical pulse is sent or transmitted from an origin in a medium and a portion of the pulse energy is reflected back to the origin due to an impedance change in the medium.

To the best of the knowledge of the applicants, time domain reflectometry has not been utilised to monitor conditions on a railway track using a track-bound system.

EP 3 135 555 A1 entitled "Route examining system and method" relates to systems and methods for examining an electrically conductive route by injecting one or more electrical examination signals into the route from an examining system which is mounted onboard a vehicle travelling on the route.

WO 2006/065730 A2 entitled "A broken rail detection system" relates to a system comprising a monitoring entity mounted on a locomotive for performing broken rail detection on a railway track.

OBJECT OF THE INVENTION

Accordingly, it is an object of the invention to provide a device, system and method of monitoring conditions on a railway track with which the applicants believe at least some of the aforementioned disadvantages may at least be alleviated or which may provide an alternative for the known devices, systems and methods.

SUMMARY OF THE INVENTION

According to the invention there is provided a monitoring device for a track-bound monitoring system for monitoring conditions on a railway track comprising a first rail and a second rail, the monitoring device comprising:

a signal generation unit having an output, the signal generation unit being configured to generate at the output an electrical monitoring signal having a monitoring signal characteristic, the output being electrically connectable to at least one of the first rail and the second rail;

a signal sensing unit having an input, the signal sensing unit being sensitive to signals at the input, the input being electrically connectable to at least one of the first rail and the second rail; and a controller which is connected to the signal generating unit and to the signal sensing unit;

the controller being configured to cause the signal generation unit to generate the monitoring signal which propagates in the first rail and to receive from the sensing unit a return signal, the return signal being derived from the monitoring signal and having a return signal characteristic; and the controller further being configured to utilize a time difference between the monitoring signal characteristic and the return signal characteristic to monitor conditions on the railway track.

The conditions may comprise at least one of: occupancy of the railway track by a rail vehicle; position of a rail vehicle on the railway track; speed of travel of a railway vehicle on the railway track; position of a rail vehicle axle on the railway track; direction of travel of a railway vehicle on the railway track; buckling of at least one of the first and second rails; interruption of at least one of the first and second rails; a position of the interruption; a rail weld on at least one of the first and second rails; a position of the rail weld; and a condition of ballast supporting the first and second rails.

The monitoring signal may have any suitable signal shape, including but not limited to one of sinusoidal, a combination of sinusoidal signals, a block and a pulse.

In some embodiments the monitoring signal characteristic may comprise one of: a leading edge of the monitoring signal; and a near vertical rising portion of a leading edge of the monitoring signal.

The return signal characteristic may correspond with the monitoring signal characteristic.

In other embodiments or applications, the monitoring signal characteristic may be different from the return signal characteristic. For example, in such embodiments or applications, the monitoring signal characteristic may comprise the leading edge of the monitoring signal and the return signal characteristic may be a change in the gradient of a leading edge of the return signal.

In some embodiments, the derived return signal may comprise the electrical monitoring signal which is transferred from the first rail onto the second rail by an electrical connection provided between the first rail and the second rail.

The electrical monitoring signal may comprise a pulse having a width or time duration at least as long as the time it would take the pulse to propagate from the output, in the first rail, through the electrical connection and in the second rail to the input, the monitoring signal characteristic may comprise a leading edge of the pulse and the return signal characteristic may comprise a corresponding edge in the return signal.

The controller may comprise a timer for timing the difference between the monitoring signal characteristic and the return signal characteristic.

The device may comprise an impedance arrangement which is electrically connectable to the second rail to cause at least one of: a reflection of the electrical monitoring signal propagating on the second rail; and a second electrical monitoring signal to propagate on the second rail.

The device may comprise a first port and a second port, the output of the signal generating unit and a first input of the signal sensing unit may be connected to the first port and the impedance arrangement may be connected to the second port.

A second input port of the signal sensing unit may be connected to the second port.

Hence, in other embodiments, the electrical monitoring signal may comprise a pulse and the derived return signal may be a reflection of the electrical monitoring signal on the first rail from one of: an electrical connection between the first and second rails, an impedance mismatch on the second rail and a discontinuation of the railway track.

According to another aspect of the invention there is provided a track-bound system for monitoring conditions on a railway track comprising a first rail and a second rail, the system comprising:

a device as defined above which is connected at a first location on the railway track and for launching the monitoring signal in at least one of the first rail and the second rail; and at least one electrical connection between the first rail and the second rail and which is spaced from the first location, the electrical connection, in use, causing the return signal to be passed between the first and second rails, to be monitored at the device.

The at least one electrical connection may comprise one of: a short; an impedance element; and a network of impedance elements providing an impedance.

The at least one electrical connection may be permanent and stationary.

The electrical monitoring signal may comprise a pulse having a length at least as long as the time it would take the pulse to propagate from the output port, in the first rail, through the at least one electrical connection and in the second rail back to the input port of the device.

The system may comprise at least one permanent connection, the device may be provided immediately adjacent an electrical block joint in one of the first rail and the second rail on one side of the device and conditions on the railway track on another side of the device may be monitored.

The railway track may be longitudinally divided into a plurality of immediately adjacent sections each being separated from immediately adjacent sections by spaced first and second permanent boundaries. The first boundary may comprise an electrical connection between the first and second rails and the second boundary may comprise one of a block joint on at least one of the tracks and an electrical connection between the first and second.

The system may comprise a device in each section intermediate the first and second boundary.

The device may be provided in the middle between the first and second boundary electrical connections.

The device may be provided off-centre the first and second boundary electrical connections.

In at least some of the sections, a second monitoring signal may also be launched in one of the first rail and the second rail from one of the first location and a second location which is spaced from the first location.

The monitoring signal at the first and second locations may be launched at different times.

In other embodiments of the system, at least first and second monitoring devices are provided in at least some of the sections at spaced first and second locations in the sections.

The first device may be provided at the first location which may be a first distance from the first boundary electrical connection and the second device may be provided at the second location which may be the first distance from the second boundary electrical connection.

The device may be housed in a sleeper of the railway track.

In another embodiment the input of the signal sensing unit may be electrically connected to the first rail, and the electrical monitoring signal may comprise a pulse having a width at least as long as the time it would take the pulse to propagate from the output, in the first rail, through the at least one electrical connection, in the second rail to the impedance arrangement where it is reflected back in the second rail, through the electrical connection and in the first rail to the input of the signal sensing unit.

According to yet another aspect of the invention there is provided a method of monitoring conditions on a railway track comprising a first rail a second rail and a spaced electrical connection provided between the first rail and the second rail the method including the steps of:

causing, from a first location along the railway track, an electrical monitoring signal to propagate in at least one of the first rail and the second rail, the monitoring signal having a monitoring signal characteristic;

sensing on at least one of the first rail and the second rail for a return signal which is derived from the electrical monitoring signal, the return signal having a return signal characteristic; and utilizing a time difference between the monitoring signal characteristic and the return signal characteristic to monitor conditions on the railway track.

The conditions may comprise at least one of: occupancy of the railway track by a rail vehicle; position of a rail vehicle on the railway track; position of a rail vehicle axle on the railway track; speed of travel of a railway vehicle on the railway track; direction of travel of a railway vehicle on the railway track; buckling of at least one of the first and second rails; interruption of at least one of the first and second rails; a position of the interruption; a rail weld on at least one of the first and second rails; a position of the rail weld; and a condition of ballast supporting the first and second rails.

The monitoring signal may have any suitable signal shape, including but not limited to one of sinusoidal, a combination of sinusoidal signals, a block and a pulse.

The monitoring signal characteristic may comprise one of: a leading edge of the monitoring signal; and a near vertical rising portion of a leading edge of the monitoring signal.

The return signal characteristic may correspond with the monitoring signal characteristic. In other embodiments or applications, the monitoring signal characteristic may be different from the return signal characteristic. For example, in such embodiments or applications, the monitoring signal characteristic may comprise the leading edge of the monitoring signal and the return signal characteristic may be a change in the gradient of a leading edge of the return signal.

In some forms of the method the derived return signal comprises the electrical monitoring signal which is transferred from the first rail onto the second rail by the spaced electrical connection which is provided between the first and second rails and wherein the derived return signal is sensed on at least the first rail and the second rail.

The spaced electrical connection may comprise one of a permanent and stationary electrical short, a permanent and stationary impedance arrangement and an axle of a rail vehicle on the railway track.

The monitoring signal may comprise a pulse.

The pulse may have a width at least as long as the time it would take the pulse to propagate from a first location, in the first rail, through the spaced permanent and stationary electrical connection and in the second rail back to the first location.

The time difference between the leading edge of the electrical monitoring signal and a corresponding characteristic of the return signal may be used to predetermine a reference round-trip time period it takes the pulse to propagate from the first location, in the first rail to the permanent and stationary electrical short or the permanent and stationary impedance arrangement, through the permanent and stationary electrical short or the permanent and stationary impedance arrangement and in the second rail back to the first location, the monitoring signal characteristic may comprise a leading edge of the pulse and the return signal characteristic may comprise a corresponding edge in the return signal.

The method may include, when a first return signal having a first round-trip time shorter than the reference round-trip time is sensed, utilizing the first return signal to determine at least one of the presence of a rail vehicle between the first location and the permanent and stationary electrical short or the permanent and stationary impedance arrangement and a distance between the first location and an axle of the rail vehicle.

The method may include, when a second return signal having a second round-trip time which is different from the first round-trip time and shorter than the reference round-trip time is sensed, utilizing the first return signal and the second return signal to determine at least one of direction of travel of the rail vehicle and speed of travel.

The method may include, when a return signal having a round-trip time longer than the reference round-trip time is sensed, utilizing the return signal to identify buckling of at least one of the first and second rails.

In some forms of the method, a second return signal characteristic may comprise a change in a gradient of a leading edge of the return signal and the method may include, when there is received a return signal having a round-trip time equal to the reference round-trip time and which, when compared to earlier signals, comprises a change in gradient compared to a reference value, utilizing the change and the time difference between the monitoring signal characteristic and the change, to determine at least one of a worsening condition of the ballast and position of the worsening condition.

The method may further include that when no return signal is sensed, identifying an interruption in at least one of the first and second tracks.

The method may include using consecutive detections of a rail vehicle moving towards the device in a direction, before moving further away from the device while moving in the same direction to detect an individual rail vehicle axle as it moves from one side of the device to the other.

The method may include when the return signal is sensed with a similar round-trip time as the reference round trip time, utilizing the return signal to indicate that the section is unoccupied by a railway vehicle and no unsafe conditions are detected.

In another form, the method may include utilizing an impedance arrangement electrically connected to the second rail to at least one of cause a reflection of the monitoring signal on the second rail; and a second electrical monitoring signal to propagate on the second rail.

The impedance arrangement may be connected to the second rail at the first location.

The return signal characteristic may correspond to the monitoring signal characteristic.

The monitoring signal characteristic may comprise a leading edge of the monitoring signal and the return signal characteristic may comprise a leading edge of the return signal.

The monitoring signal may comprise a pulse.

The pulse may have a width at least as long as it would take the monitoring signal to propagate from the first location, along the first rail through the at least one electrical connection, in the second rail to the impedance arrangement where it is reflected back in the second rail, through the electrical connection and in the first rail to the first location where it is monitored.

The method may further include utilizing a time difference between a time relating to the monitoring signal characteristic and a time of interference between the monitoring signal and the return signal at the first location to compute a distance from the first location to the electrical connection.

BRIEF DESCRIPTION OF THE ACCOMPANYING DIAGRAMS

The invention will now further be described, by way of example only, with reference to the accompanying diagrams wherein.

Figure 12A:
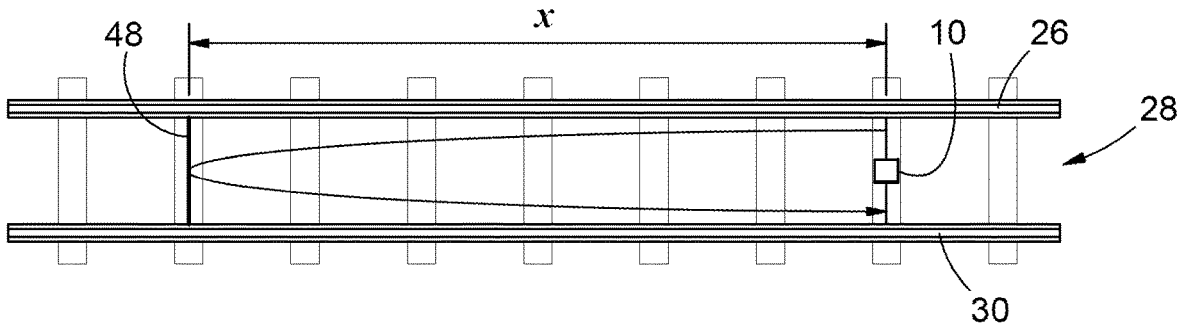
Figure 12B:
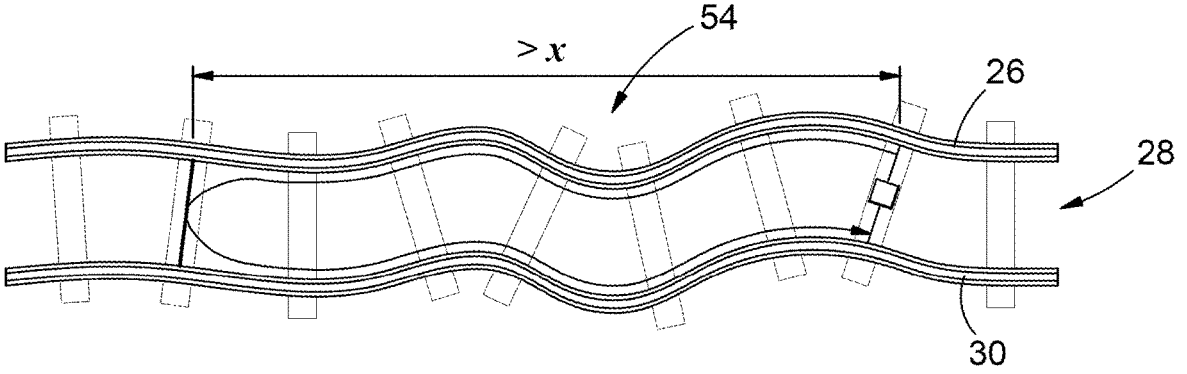
Figure 12C:
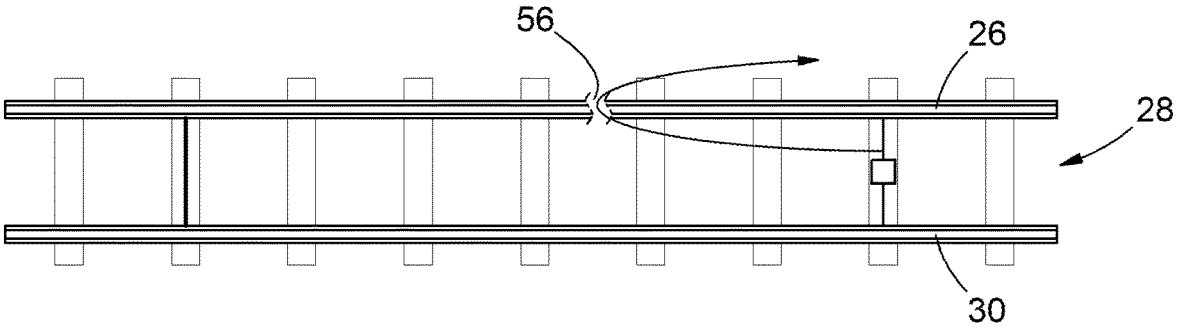
Figure 13:
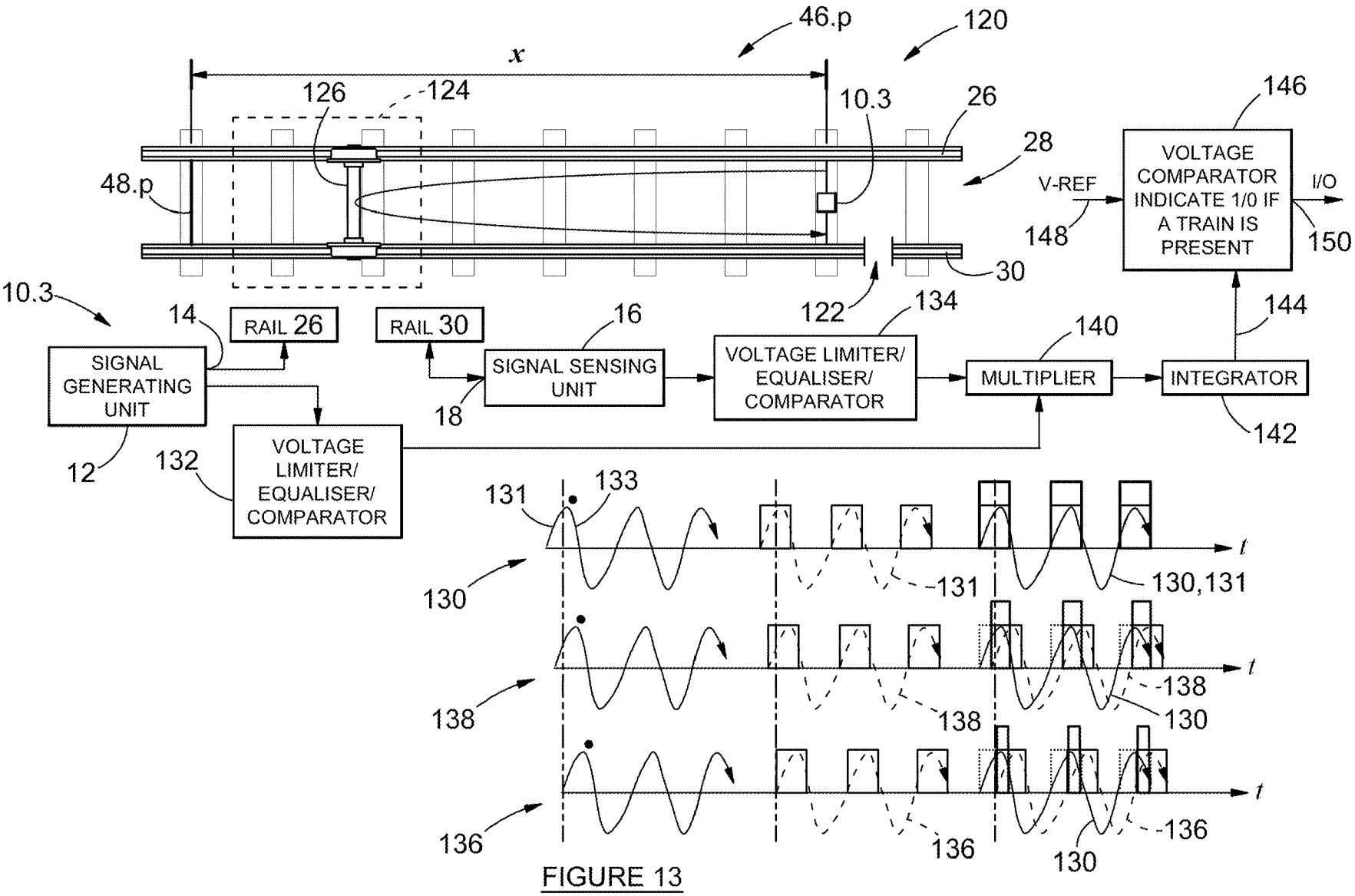
Figure 14:
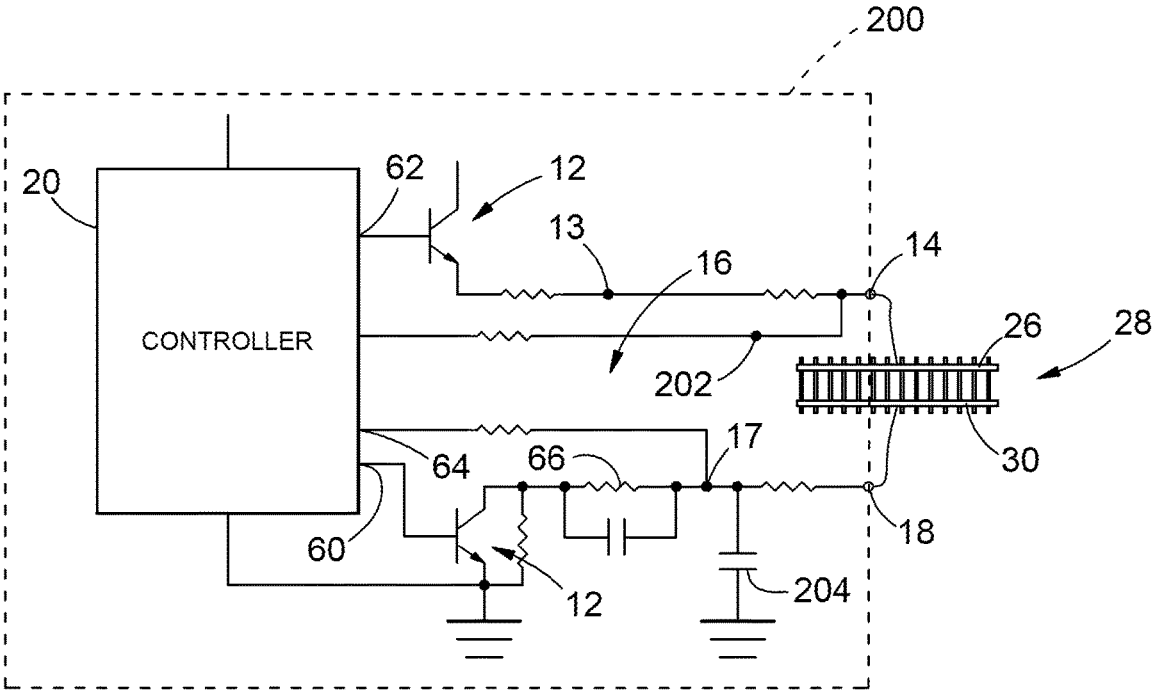
Figure 15:
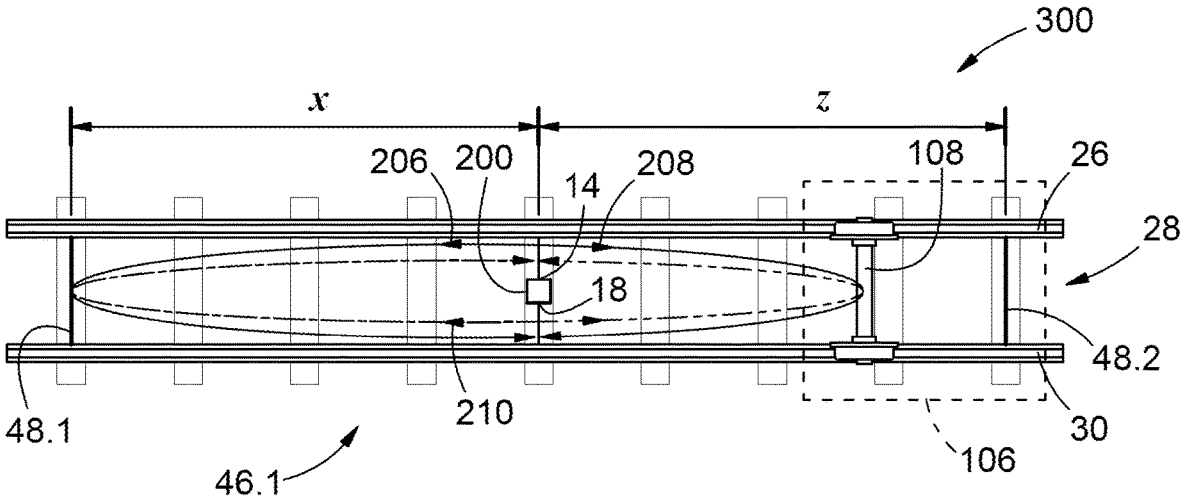
Figure 16:
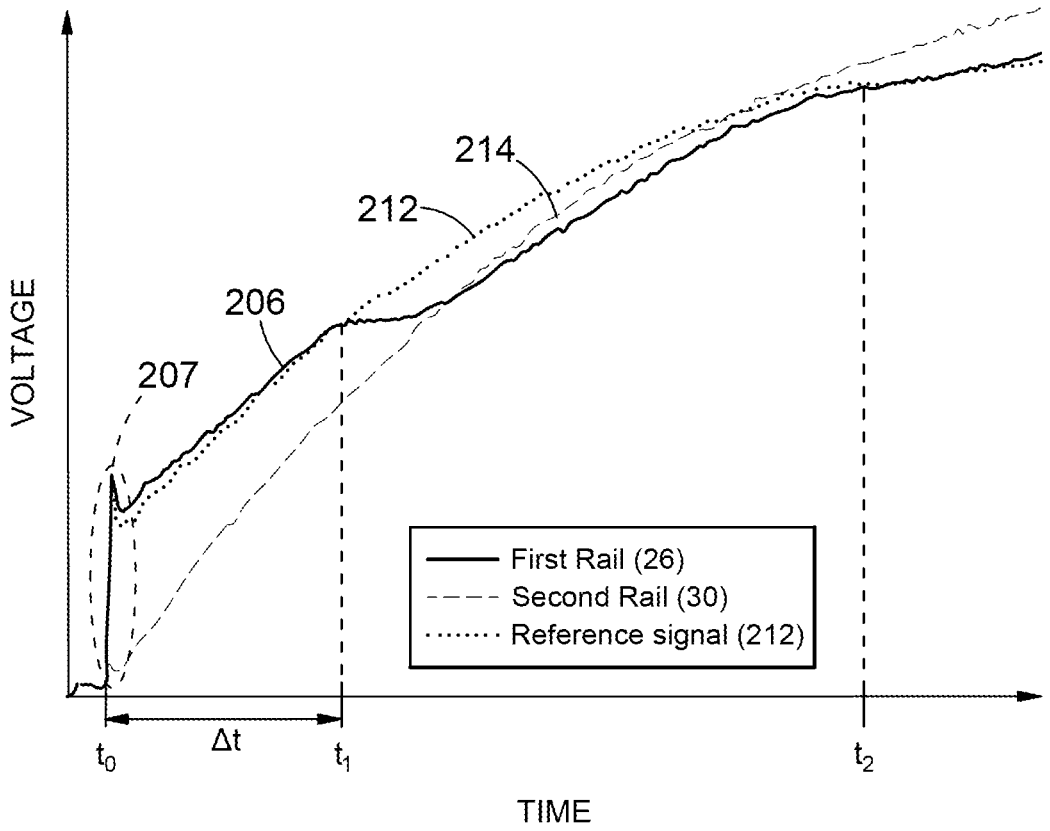
Figure 17:
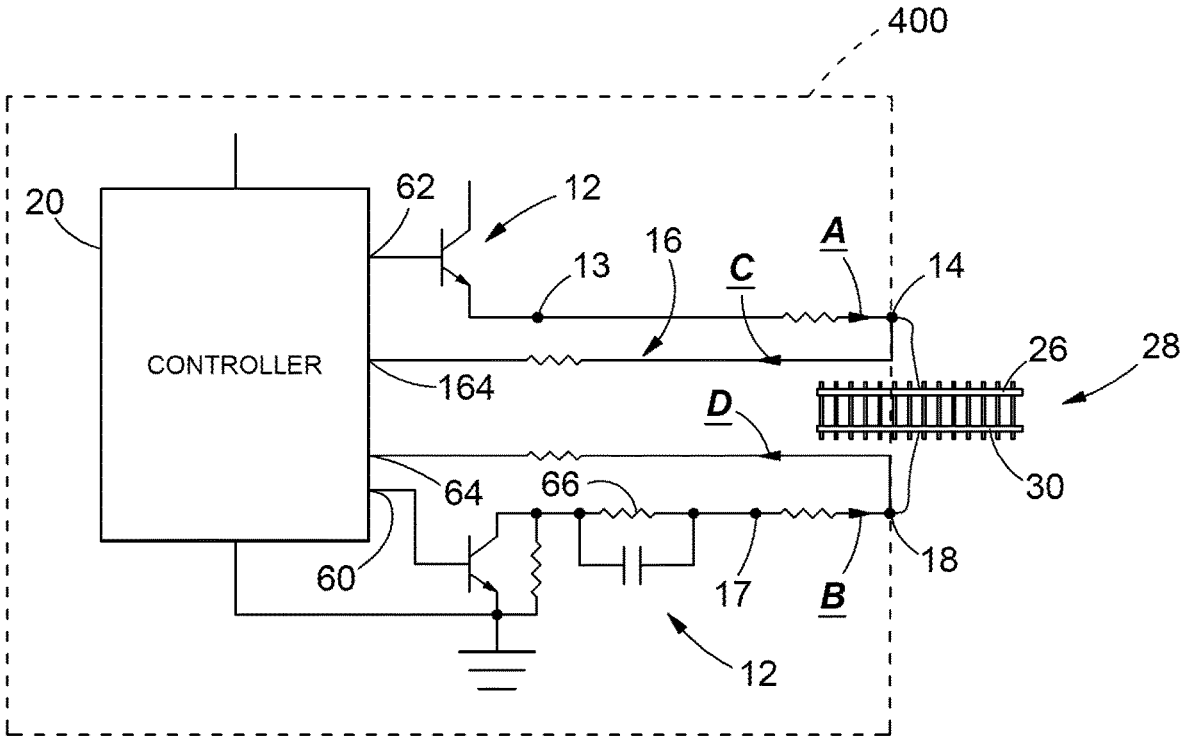
Figure 18:
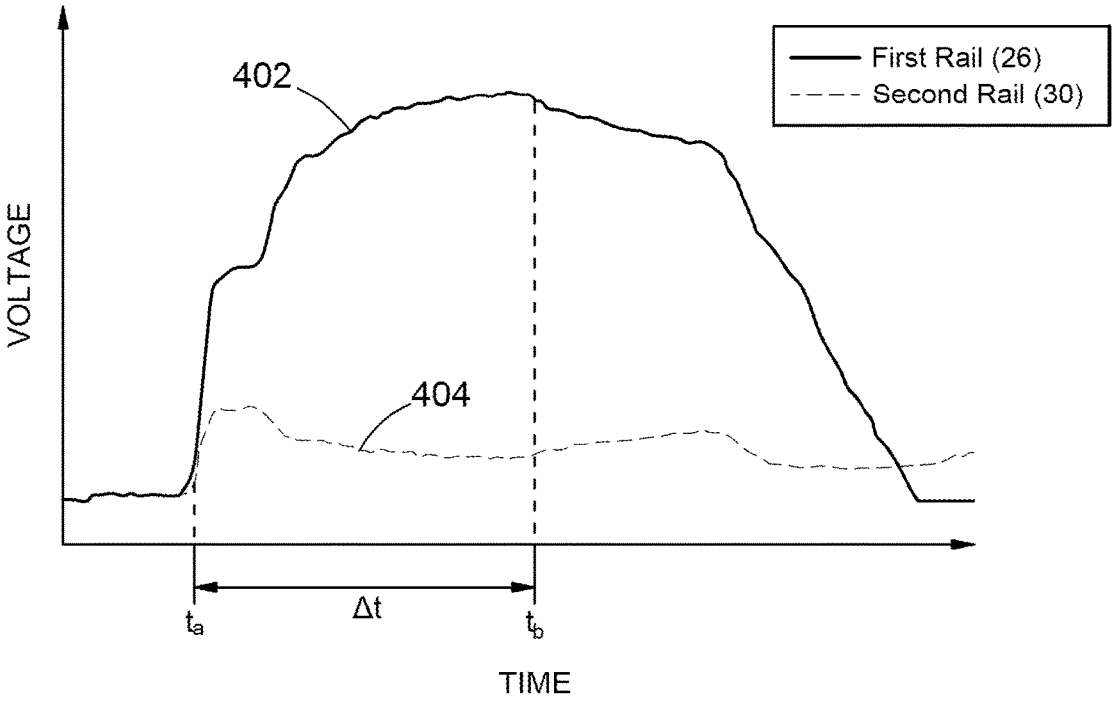
Figure 19:
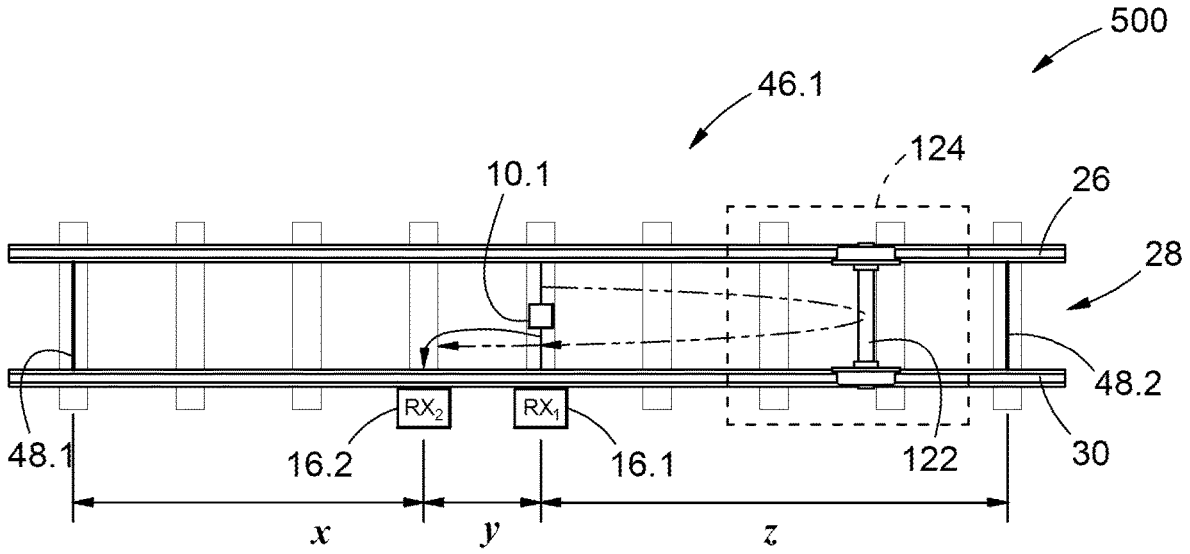

FIGS. 12(*a*)-12(*c*) are plan views of relevant parts of the railway track illustrating monitoring different conditions on the railway track;

FIG. 13 is a diagram illustrating further example embodiments of the device, the system and the method;

FIG. 14 is a diagram of a further example embodiment of the monitoring device connected to the railway track;

FIG. 15 is a plan view of relevant parts of the railway track illustrating another example embodiment of a track-bound monitoring system for the railway track;

FIG. 16 is an oscillograph (voltage against time) of signals sensed on the first rail and the second rail in FIG. 15;

FIG. 17 is a diagram of a further example embodiment of the monitoring device connected to the railway track;

FIG. 18 is an oscillograph (voltage against time) of signals sensed on the first rail and the second rail in FIG. 17; and FIG. 19 is a plan view of relevant parts of the railway track illustrating another example embodiment of a track-bound monitoring system for a railway track.

DESCRIPTION OF PREFERRED EMBODIMENTS OF THE INVENTION

Figure 1:
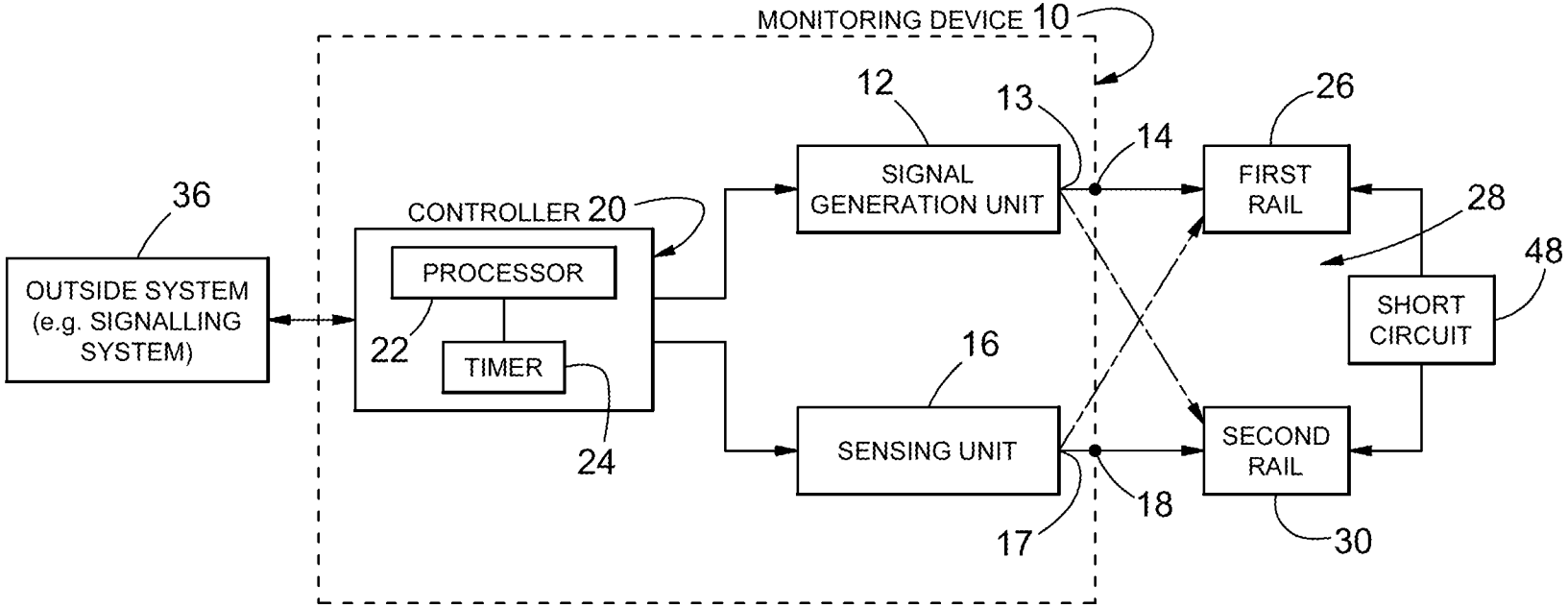
FIG. 1 is a block diagram of an example embodiment of a track-bound device for a track-bound system for monitoring conditions on a railway track.

A first example embodiment of a track-bound device for monitoring conditions on a railway track is generally designated by the reference numeral 10 in FIG. 1.

The device 10 comprises a signal generation unit 12 having an output 13. The signal generation unit 12 is configured to provide at a first port 14 of the device 10 an electrical monitoring signal 82 (shown in broken lines in FIG. 8). The electrical monitoring signal has a monitoring signal characteristic, such as a near vertical rising portion 83 (also shown in FIG. 8). The device 10 also comprises a signal sensing unit 16 having an input 17. The signal sensing unit 16 is sensitive to signals at a second port 18 of the device 10. The device 10 also comprises a controller 20 comprising a processor 22 and a timer 24 for generating time data relative to a reference, such as the monitoring signal characteristic 83.

The controller 20 is connected to the signal generation unit 12 and to the signal sensing unit 16. The output 13 is electrically connectable to a first rail 26 of a railway track 28 and, as will be described below, the input 17 is connectable to at least one of the first rail 26 and the second rail 30. The controller is configured to cause the signal generation unit 12 to generate the monitoring signal which propagates in the first rail 26 and to receive from the sensing unit 16 a return signal 92 (shown in solid lines in FIG. 8) sensed at the device. As will be described in more detail below, the return signal 92 is derived from the monitoring signal 82 and has a return signal characteristic 94, which may correspond to the characteristic 83 of the monitoring signal. The controller 20 is further configured to utilize a time difference $\Delta t$ (shown in FIG. 8) between the monitoring signal characteristic 83 and the return signal characteristic 94, to monitor conditions on the railway track.

The controller 20 may be connectable to an external system 36, such as a signalling system, remote controllers including associated databases (not shown) and data communications systems (also not shown).

Figure 2:
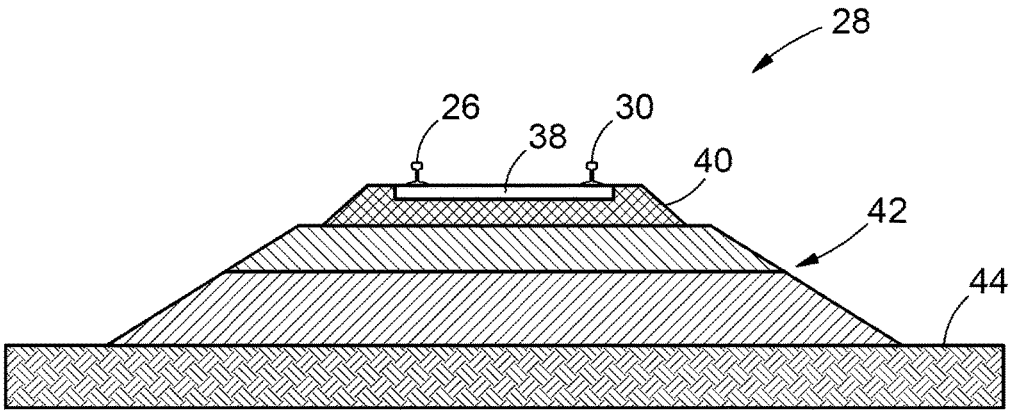
FIG. 2 is a transverse section through a known railway track.

A transverse cross section through a railway track 28 is shown in FIG. 2. The railway track comprises the first rail 26 and the second rail 30. The rails 26 and 30 are of known construction, made of a suitable metal and is electrically conductive. The rails are mounted on longitudinally spaced transversely extending railroad ties 38, also known as sleepers. The sleepers 38 are supported by a crushed stone ballast 40 above other layers 42 and natural soil 44.

Figure 3:
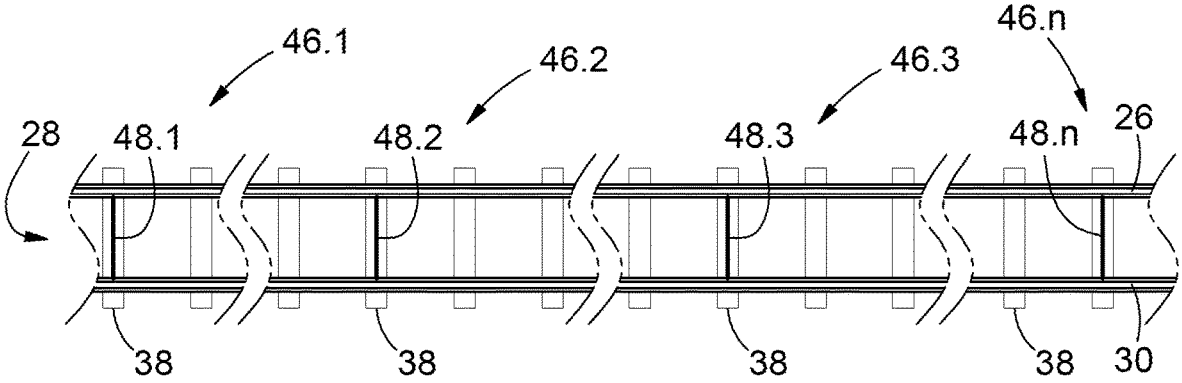
FIG. 3 is a plan view of a length of railway track divided into a plurality of adjacent sections.

As shown in FIG. 3, the railway track 28 may be divided into a plurality of longitudinally immediately adjacent blocks, which may also be referred to as sections 46.1 to **46.*n*. Between any two immediately adjacent sections (such as sections 46.1 and 46.2) there is provided a permanent electrical boundary connection, such as short 48.2, between conductive rails 26 and 30**, as will be described in more detail below.

The conditions on the railway track 28 that may be monitored may comprise (but is not limited to) at least one of: occupancy by and position 50 of a rail vehicle 51 (shown in FIG. 6) having a front axle 52 on the railway track; speed and direction of travel of the rail vehicle 51; buckling 54 (shown in FIG. 12(*b*)) of at least one of the first rail 26 and the second rail 30; interruption 56 (shown in FIG. 12(*c*)) of at least one of the first and second rails; a condition of ballast 40 supporting the first and second rails; and the position of a track turnout in certain conditions.

Figure 4:
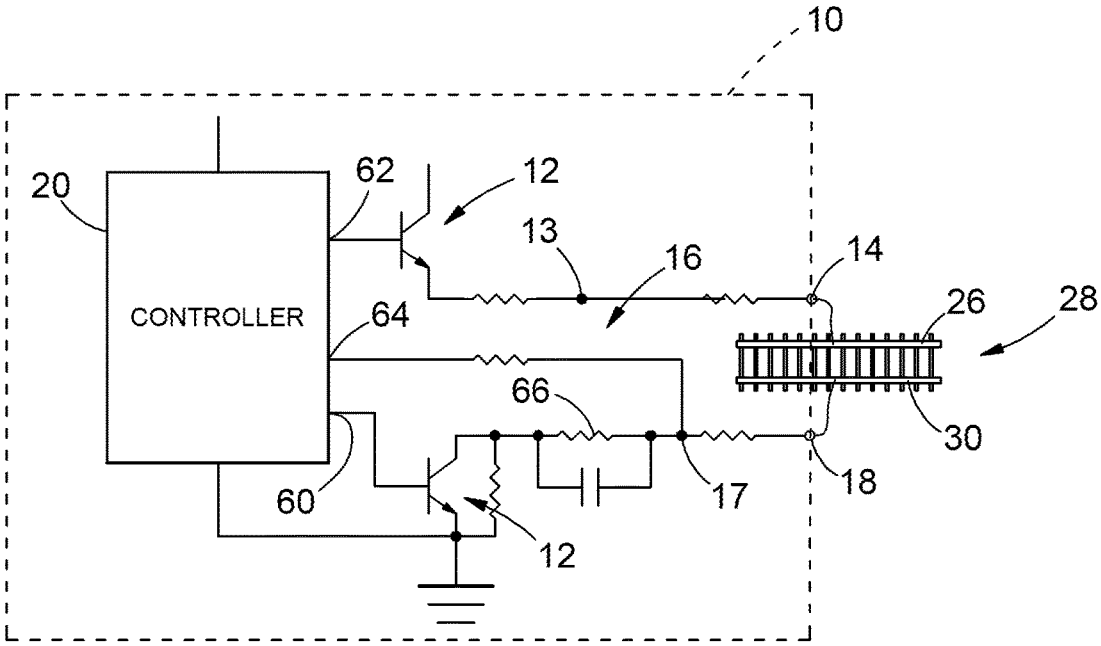
FIG. 4 is diagram of an example embodiment of the device connected to first and second rails of the railway track.

In FIG. 4, more detail of one example embodiment of the device 10 is shown. The controller comprises an ATMEGA microprocessor 22 running at 16 MHz. The signal generation unit 12 and sensing unit 16 are shown in more detail. Pins 60 and 62 are used to trigger generation of the monitoring signal in the form of a pulse. Resistor 66 and parallel capacitor serves to convert the current at port 18 into a useful voltage for monitoring. Pin 64 is used to monitor that voltage. This pin is either configured as an analogue to digital converter pin, or an input pin, depending on a desired monitoring method for a specific generated pulse.

Figure 5:
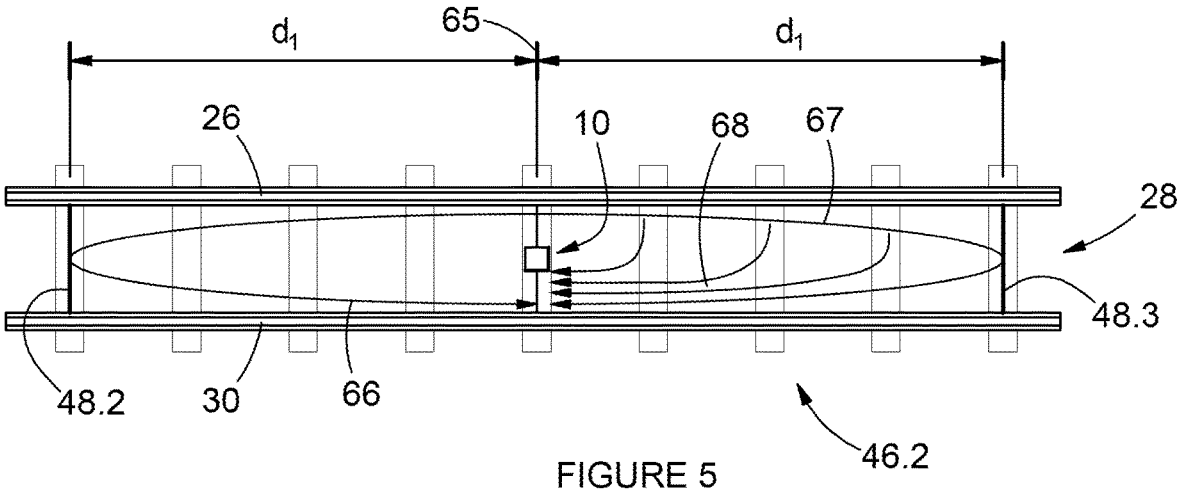
FIG. 5 is a plan view of relevant parts of the railway track illustrating a first example embodiment of a track-bound system for monitoring conditions on a railway track comprising the device.

Referring to FIG. 5, the track-bound device 10 is located at a first location 65 in section 46.2 in the middle between permanent boundary shorts 48.2 and 48.3. The permanent boundary shorts 48.2 and 48.3 may be provided, as an example, a first distance $d_1$=1200 m from the device 10. In an example embodiment, the electric monitoring signal 67 (which propagates in opposite directions away from the device 10 on rail 26) comprises a pulse having a leading edge and a width or time duration at least as long as the time it would take for the pulse to propagate from the port 14, in the first rail 26, through the short 48.3, for example, and in the second rail 30 back to the input port 18 of the device. In this example embodiment, the derived return signal comprises the electrical monitoring signal 67 which is transferred from the first rail 26 onto the second rail 30 by the permanent short 48.3 and leakage currents 68. In other example embodiments (not illustrated), the derived return signal may be a reflection of the monitoring signal (for example, from the electrical connection 48.3 between the rails or from the device 10, as will be explained in more detail below) and in such embodiments, the input port 17 may be connectable to the first rail 26.

Figure 6:
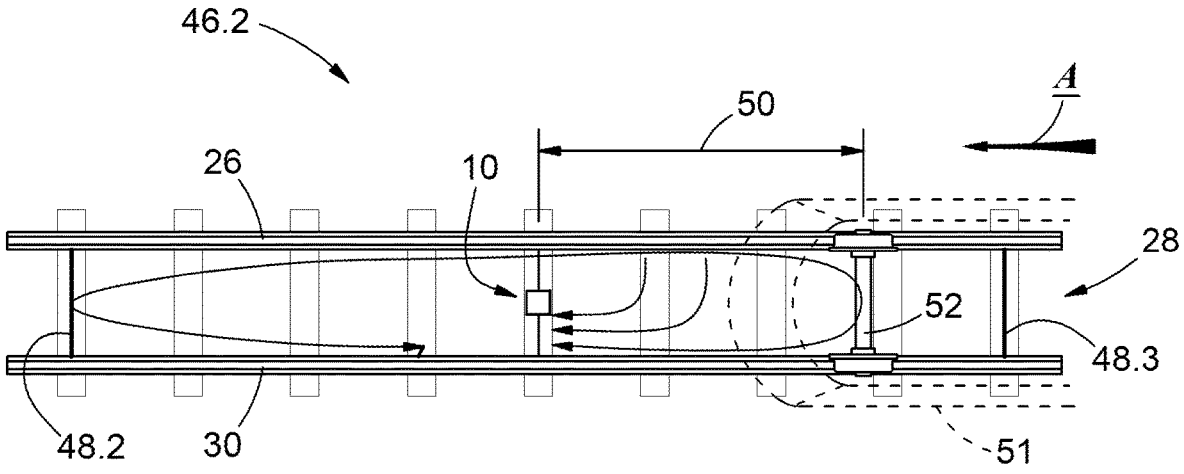
FIG. 6 is a plan view of relevant parts of the railway track illustrating a second example embodiment of a system comprising the device and with a railway vehicle in the monitored track section.
Figure 7:
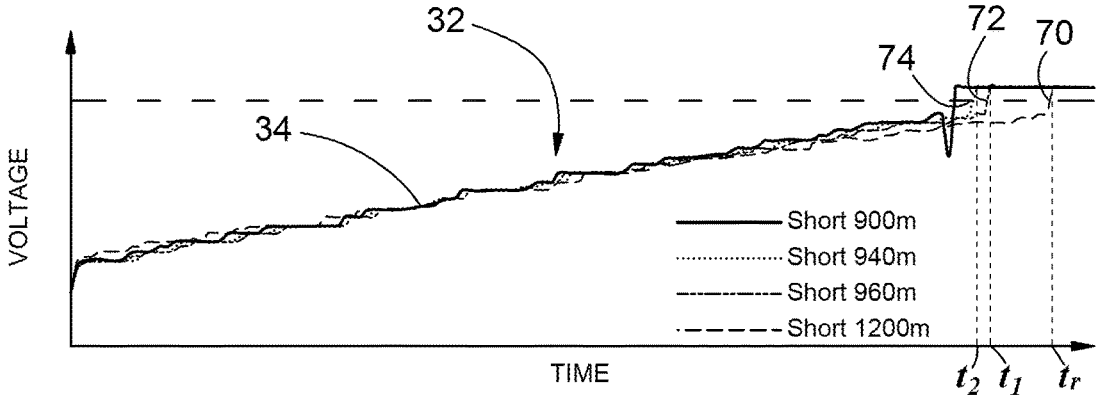
FIG. 7 is an oscillograph (voltage against time) of a return signal sensed on the second rail in response to a pulse being connected to the first rail.

Referring to the example embodiment of FIGS. 6 and 7, as best shown in FIG. 7, the return signal 32 comprises a leading edge 34 having a gradient having an average value which may be considered a reference value. The steep or fast change in slope at 70 in FIG. 7, which is higher than the reference value, is when the leading edge of the monitoring signal, now as part of the derived return signal, reaches the input 17. The pulse takes a reference round-trip time $t_r$ to travel from the output 13 via the permanent short 48.3 to the input 17, as described above.

Referring to FIG. 6, should a train 51 travelling in direction A enter the section 46.2, the axle 52 between the front wheels provide a temporary and moving electrical short between the first rail 26 and the second rail 30 which is closer to the device 10 than the permanent boundary shorts 48.2 and 48.3. A monitoring pulse from the device 10 would take a first round-trip time, which is shorter than the reference round-trip time, to arrive at the input 17. Arrival at the input 17 of the leading edge is evidenced by change in slope 72 in FIG. 7. As the train 51 moves closer to the device 10, so does the temporary short presented by axle 52. A monitoring pulse from the device 10 would take a second and even shorter round-trip time to arrive at the input 17. Arrival at the input 17 is evidenced by change in slope 74 in FIG. 7. Data relating to slope changes 72 and 74 and the associated round-trip time data $t_1$ and $t_2$ may be used to determine the location (in terms of meters from a reference location, such as the above first location where the device 10 is located) of the train in section 46.2 as well as speed of travel.

Figure 8:
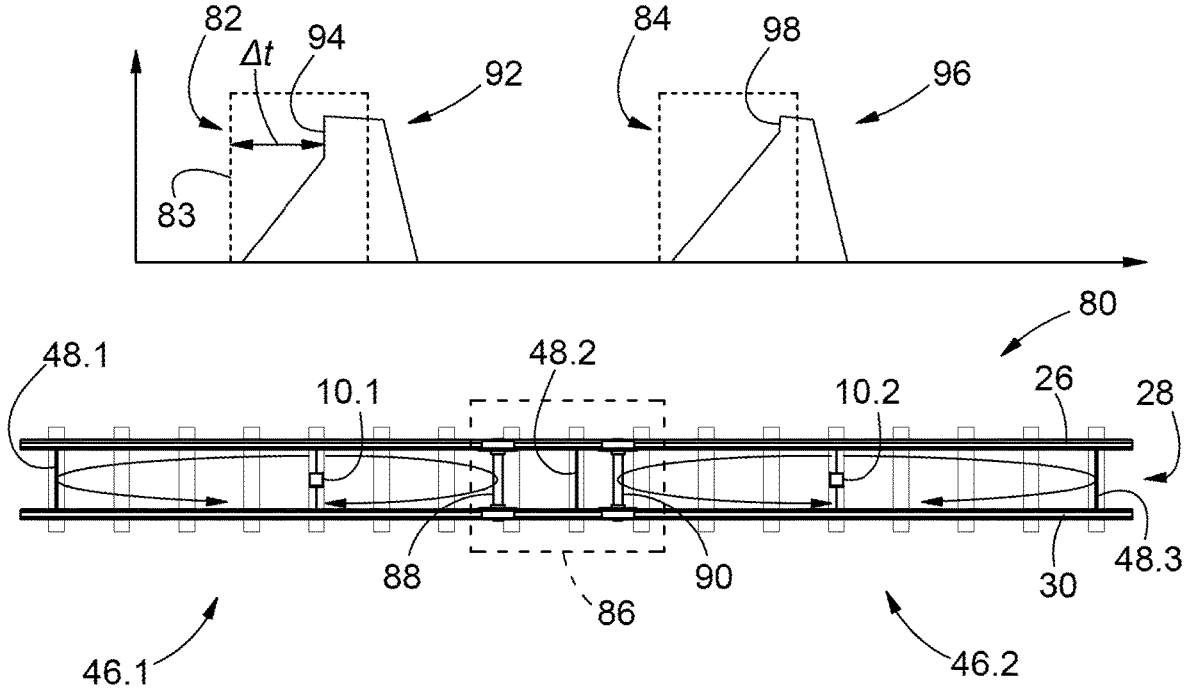
FIG. 8 is a plan view of relevant parts of the railway track illustrating an example embodiment of a track-bound monitoring system for a railway track and with a railway vehicle present across a section boundary.

A further example embodiment of the monitoring system for a railway track is shown at 80 in FIG. 8. In this system a first device 10.1 is provided in the middle of section 46.1 a distance of xm from each of the permanent boundary shorts 48.1 and 48.2 of section 46.1. A second device 10.2 is provided in the middle of section 46.2 a distance of ym from each of the permanent boundary shorts 48.2 and 48.3 of section 46.2. The lengths of all the sections 46.1 to **46.*n* may be the same, so that x=y, or, they may be different, so that x≠y. The first device 10.1 launches a first pulse 82 having a leading edge 83 on first rail 26 which propagates in opposite directions in first rail 26. Similarly, the second device 10.2 launches a second pulse 84 on first rail 26 which propagates in opposite directions in first rail 26. The pulses 82 and 84 may be synchronized or they may not be synchronized. With a train 86 having a front axle 88 and a rear axle 90 straddling a boundary 48.2 on the railway track 28 as shown in FIG. 8, the first pulse 82 from first device 10.1 would first reach temporary short 88 presented by front axle 88 before the same pulse propagating in the opposite direction reaches permanent boundary short 48.1. The return signal via the temporary short is shown at 92. Receipt of the leading edge as part of the return signal via temporary short 88 at input 17 is indicated by the change 94 in the slope of the return signal. Similarly, the second pulse 84 from second device 10.2 would first reach temporary short 90 presented by rear axle 90 before the same pulse propagating in the opposite direction reaches permanent boundary short 48.3. The return signal via the temporary short is shown at 96. Receipt of the leading edge as part of return signal via temporary short 90 at input 17 is indicated by the change 98 in the slope of the return signal. It will be noted that because axle 90 is further away from second device 10.2 than axle 88 is from first device 10.1, gradient change 98 is later in time referenced to launching compared to gradient change 94. Based on time and distance data derived from the first and second pulses, calculations may be done to determine the position of the front and rear of the train 86 on the railway track 28**, direction of travel as well as speed of travel and length of the train.

Figure 9:
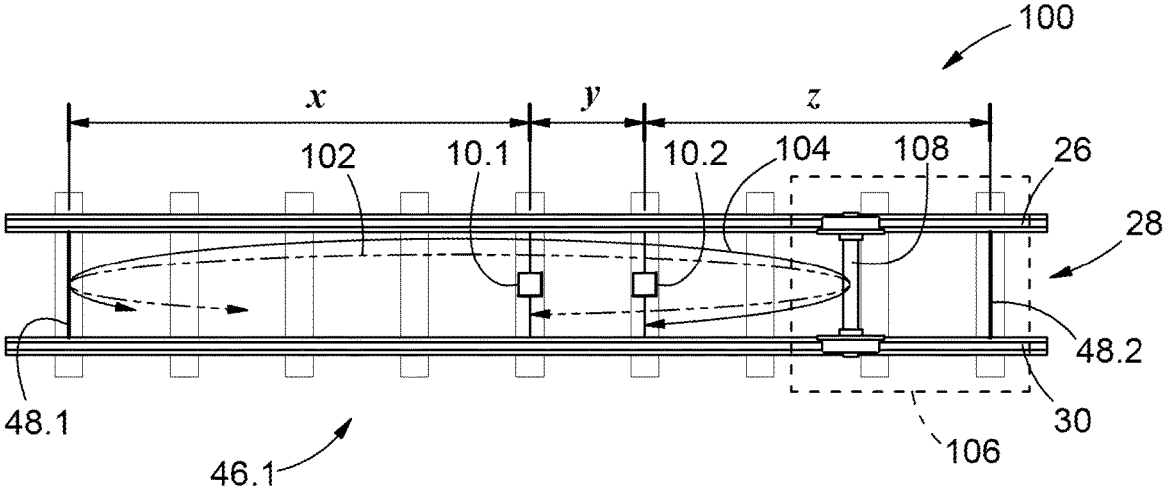
FIG. 9 is a plan view of relevant parts of the railway track illustrating another example embodiment of a track-bound monitoring system for a railway track and with a railway vehicle on the railway track.

A further example embodiment of the monitoring system for a railway track 28 is shown at 100 in FIG. 9. In this example embodiment a first device 10.1 is provided in section 46.1 at a first location xm from first permanent boundary short 48.1 and a second device 10.2 is provided in section 46.1 at a second location zm from second permanent boundary short 48.2. The distances xm and zm may be equal or they may not be equal. The first location is ym from the second location. The first device 10.1 launches a first pulse 102 on first rail 26 which propagates in opposite directions in first rail 26. The second device 10.2 launches a second pulse 104 on first rail 26 which propagates in opposite directions in first rail 26. Based on time and distance data derived from the return signals, calculations may be done to determine the position of a train 106 having an axle 108 on the railway track 28, direction of travel as well as speed of travel.

Figure 10:
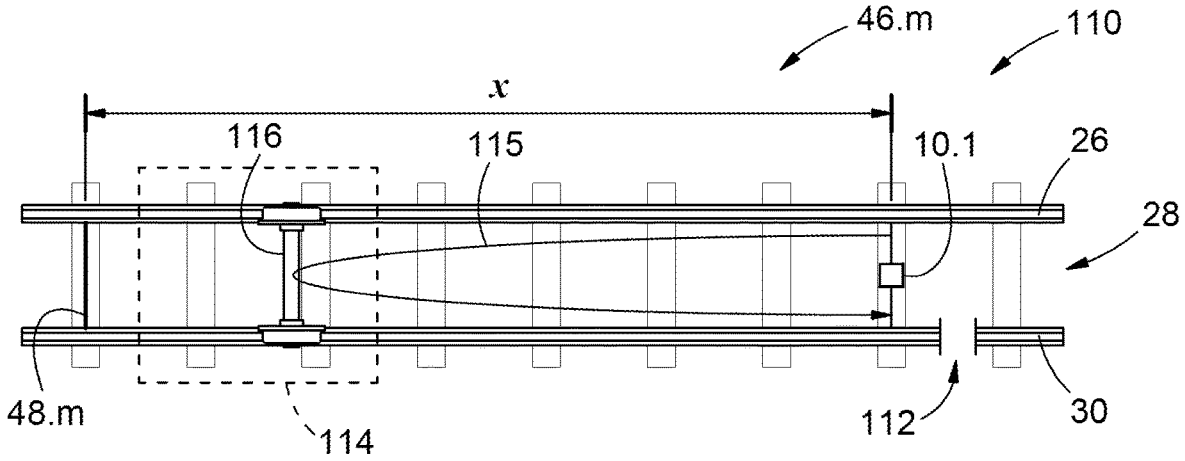
FIG. 10 is a plan view of relevant parts of the railway track illustrating another example embodiment of a track-bound monitoring system for a railway track and with a railway vehicle on the railway track.

A further example embodiment of the monitoring system for a railway track 28 is shown at 110 in FIG. 10. In this example embodiment a first device 10.1 is provided in section 46.*m* immediately adjacent a block joint 112 and xm from permanent boundary short 48.*m*. A block joint is an electrical isolation of the track, in this case rail 30, which hence allows pulse propagation in and/or detection from one direction only, thus forming a section boundary. With a train 114 having a front axle 116 located in section 46.*m*, pulse 115 launched on track 26 will reach the axle 116 before it would reach the permanent boundary short 48.*m* and based on the time data, the position of the train may be determined. Consecutive readings will enable the speed and direction of travel to be calculated.

Figure 11:
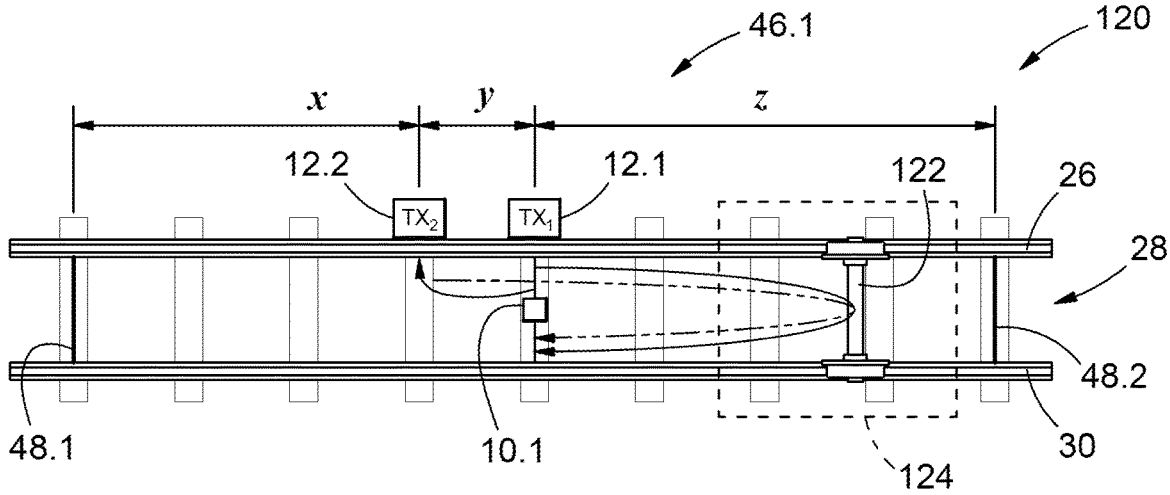
FIG. 11 is a plan view of relevant parts of the railway track illustrating another example embodiment of a track-bound monitoring system for a railway track.

A further example embodiment of the monitoring system for a railway track 28 is shown at 120 in FIG. 11. In this example embodiment a first device 10.1 is provided in section 46.1 intermediate permanent boundary shorts 48.1 and 48.2 for section 46.1. The device 10.1 comprises first and second signal generation units 12.1 and 12.2. Unit 12.2's connection to rail 26 is spaced from that of unit 12.1, thereby to launch a second monitoring signal or pulse onto rail 26 at a second spaced location in the section. In still other embodiments (not shown), the second monitoring signal may be launched at the second location on the second rail 30 and the return signal received on the first rail 26. Time and distance data relating to the separate pulses launched by the two signal generation units and its short circuiting by the axle 122 of train 124 may be used to determine the position of the train, and the direction of travel when using multiple readings. In other embodiments, the device 10.1 may comprise a single signal generation unit, but first and second sensing units (not shown) which are provided to sense return signals at first and second spaced locations on rail 30.

In FIGS. 12(*a*) and 12(*b*) there is illustrated how buckling of at least one of the rails 26 and 30 may be monitored and detected. As shown in FIG. 12(*a*), the reference round-trip time for a pulse from device 10 to permanent boundary short 48, a distance xm from the device 10, is known. Should this round-trip time suddenly increase, it would indicate a lengthening of the total length of rails 26 and 30 between the device 10 and the permanent boundary short 48, which could be the result of expansion of one or both rails due to heat or ground disturbance and hence buckling at 54 of the railway, as illustrated in FIG. 12(*b*).

In FIG. 12(*c*), an interruption 56 in at least one of the rails 26 and 30 is detected in that an expected return signal in response to a monitoring signal on the first rail 26 is no longer detected on the second rail 30 or via a reflected signal on rail 26. Conventional track circuits cannot detect if an interruption occurs on a traction return rail, due to backup traction cables providing an alternative low resistance path for the signal. The device 10 can detect such interruptions as the return path via the traction cables would be longer, thus causing the expected return signal to arrive later than expected. An interruption 56 in at least one of the rails 26 and 30 can be detected at both sides of the device 10 by using a multiple signal generation unit device as indicated in FIG. 11, or by using a single device while ensuring that the permanent electrical connection forming the section boundaries are impedance connections each allowing a different frequency range to pass from rail 26 to rail 30. This is accomplished by generating a monitoring signal within each frequency range one after the other thus allowing each side of the device to be monitored for rail breaks.

The device 10 may be installed in a specialized standard size sleeper 38 with wireless communication (not shown) and charging devices (not shown) such as solar panels and electromagnetic harvesters built into the sleeper without exposing any cables to the outside world. In another scenario communication as well as power can be provided to the device installed in the sleeper via fiber optic cables using the known concept of 'Power Over Fiber'.

The fact that the device 10 can be installed entirely at a single location along the railway track 28, as opposed to other systems requiring inter-connected devices or installations on the track monitoring boundaries resulting in extensive cable requirements, and the physical small size and expected low power demands of the device 10, makes it ideal to be concealed inside a railway sleeper 38. Electrical connection to the rails 26, 30 can be accomplished in several ways such as with rail clamps, connected cables, or pins extruding from the sleeper making electrical connection with the rail from the bottom.

A low energy, battery operated device 10 installed in the rail environment (for example, inside a sleeper) could be recharged without a cable in several ways. At some locations it might be practical to use solar panels e.g. built into the sleeper, others such as electrical railways could consider harvesting magnetic radiation from the current flowing in the railway track. The induced current can be due to trains, or due to a special setup in the electrical substations (or locations between electrical sections) causing varying current to flow in the rail due to a load supplied on the far end of the overhead line. Such a setup is available on some DC substation circuit breakers, where one end of the overhead line is disconnected from the voltage source, and connected to the traction return rail via a load (e.g. 2000 resistor). This causes a current to flow in the return rail that can be measured to provide detail regarding the electrical installation. Enabling and disabling this test function would result in a varying current flowing in the rail as one example for when no trains are moving in the area, allowing this method to be used as an energy source on demand. Heat conversion is another possible energy source, as a railway track exposed to the sun heats up to high temperatures faster than its surroundings. Various methods could be used either on their own or in combination to charge the battery when different sources are available, and thus reduces the requirement for power cables extending from the device 10.

Detecting a train with its direction of travel at frequent intervals to produce a high resolution of less than 0.5 m distance accuracy can enable the device to track a train axle as the train moves over the device. This is done by tracking the closest axle as it moves towards the device, before moving further away from the device while moving in the same direction. This indicates that the axle has moved from one side of the device to the other. Detecting another short on the opposite side than the first axle while traveling in the same direction as the first axle indicates that a second axle has been detected. This method can be used to count the number of axles travelling over the device in a specific direction and also enables the calculation of distance between axles and train length.

In FIG. 13 there is shown yet another embodiment of the device 10.3 which is installed on a section 46.*p* of the railway track 28. The section 46.*p* is adjacent a block joint 122 and has a spaced permanent boundary 48.*p*.

The signal generation unit 12 of device 10.3 is electrically connected to the first rail 26 via the first port 14 and the signal sensing unit 16 is electrically connected to the second rail 30 via the second port 18, as described above. The signal generation unit 12 generates a sinusoidal monitoring signal 130 having a rising edge 131, a falling edge 133 and a relatively low frequency of, for example, in the order of 10 kHz. The device 10.3 comprises signal conditioning circuitry 132 for the monitoring signal and signal conditioning circuitry 134 for the sensed return signal. The sensed return signal (136 or 138 which are referred to in more detail below) is expected to resemble a sinusoidal wave, because leakage currents are limited at low frequencies. The amplitude might differ and hence the conditioning circuitry 134. The device further comprises a multiplier 140, and integrator 142 having an output 144 and a voltage comparator 146 utilizing a reference voltage 148 and having an output 150.

Wave forms for three scenarios are provided. The first being a return signal 131 which would be received when there is a short (not shown) present at the device location. In this case, the return signal 131 would be similar to the monitoring signal 130. The second scenario is with a short caused by axle 126 of rail vehicle 124 within the section 46.*p*. This return signal 138 has a delay compared to the monitoring signal 130. The third scenario is with only the permanent boundary short 48.*p* of the section and no rail vehicle in the section. This return signal 136 has the longest delay compared to the monitoring signal 130. The output 144 associated with this third scenario is used to determine reference voltage 148.

The return signal via the boundary 48.*p* in the case where there is no train in the section 46.*p* is shown at 136 with an indication to how it is transformed as it propagates through the system. The device 10.3 and more particularly the multiplier 140 and integrator 142 utilizes the time difference between the monitoring signal rising edge and the return signal rising edge to generate a voltage signal at output 144 which is proportional to the degree of overlap between the monitoring signal and the return signal from the permanent boundary 48.*p*. The arrangement is such that the voltage signal at 144 would be lower than the above reference value 148.

When a train 124 having a front axle 126 enters the section 46.*p*, the monitoring signal 130 will be transferred from rail 26 to rail 30 by the short provided by the axle 126, as described above. The return signal is indicated at 138 and it will be noted that because the time difference is smaller, there is a larger degree of overlap between the monitoring signal 130 and the sensed return signal 138. The resultant voltage signal at 144 is larger than the reference voltage 148, so that at output 150 a signal is provided indicating that a train is present in the section.

In FIG. 14 there is shown another example embodiment of the monitoring device, designated 200. The device 200 is similar to the device 10 in FIG. 4 and like parts are indicated by like numerals. However, the controller 20 of device 200 comprises a sense signal input 202 which is connected to first port 14. Furthermore, the device 200 comprises at second port 18 a termination impedance arrangement. In this example embodiment, the arrangement comprises a capacitor 204, but in other embodiments other suitable arrangements may be provided. The termination impedance arrangement 204 has an impedance different to that presented by the railway 28 to a monitoring signal which propagates in the rails 26 and 30 and the permanent or temporary shorts that transfers the monitoring signal between rails 26 and 30.

In FIG. 15 there is illustrated another example embodiment of the track-bound monitoring system, designated 300. The system 300 is similar to that shown in FIG. 9 (and like parts are indicated by like reference numerals), except that instead of monitoring unit 10.1 and 10.2, monitoring unit 200 (shown in FIG. 14) is used on the railway 28. Although in this example embodiment the unit 200 is provided at a first location adjacent the track and intermediate permanent boundary shorts 48.1 and 48.2 a distance xm from boundary short 48.1 and zm from boundary short 48.2 and wherein $x \neq z$, in other embodiments x may be equal to z and in yet other embodiments the monitoring unit may be provided spaced form one boundary short, such as boundary short 48.*m* shown in FIG. 10. The first port 14 is electrically connected to the first rail 26 and the second port 18 is electrically connected to the second rail 30. In accordance with the principles of reflectometry, the impedance arrangement at the second port 18 causes a portion of the monitoring signal 206 propagating on rail 30 to be reflected back towards its origin.

In this example embodiment, the monitoring unit 200 generates a monitoring pulse having a width or duration of at least twice as long as the time it would take for the pulse to propagate from the first port 14, through the first rail 26, the furthest permanently installed boundary short 48.1, the second rail 30 to the second port 18. At the second port 18 a portion of the monitoring pulse is reflected at impedance arrangement 204 to form a return signal which propagates back via the same route to the first port 14. The generated monitoring signal 206 in this embodiment is a pulse having a monitoring signal characteristic in the form of a near vertical rise portion 207 (shown in FIG. 16).

Still referring to FIG. 15, the monitoring signal 206 is generated by the device 200 and applied via the first port 14 to the first rail 26. The monitoring signal then propagates in opposite directions through the first rail 26. Only one case will be described further, because it will be understood that the case in the opposite direction is similar. The monitoring signal propagates from first rail 26 via the boundary short 48.1 to the second rail 30 towards the second port 18 of the device. At the terminating impedance 204 at second port 18, a portion of the monitoring signal 206 is reflected as described above and a reflection 210 travels in a direction opposite to that of the monitoring signal 206 via the second rail 30, the permanent boundary short 48.1 and the first rail 26 towards the first port 14 and sense input 202 of monitoring device 200. As the reflection 210 is derived from the monitoring signal 206, the reflection 210 has signal characteristics corresponding to that of the monitoring signal 206.

Should a train 106 having an axle 108 enter the section 46.1 of the railway 28, the monitoring signal travels through the temporary short provided by axle 108, instead of through the boundary short 48.2.

Referring to FIG. 16, when the leading edge of the reflection reaches the first port 14, the reflection interferes destructively at time $t_1$ with the monitoring signal 206. This deformation indicates the presence of the train 106 and the time from to of the deformation may be used to calculate the distance of the train from the device 200. More particularly, a time difference $\Delta t$ between time to when the near vertical rise portion 207 of the monitoring signal 206 is identified and $t_1$ allows for a calculation to be performed to determine the distance between the device 200 and the train axle 108.

In the same manner, the reflection 210 of the monitoring signal in the opposite direction via boundary short 48.1 will similarly cause a deformation of the monitoring signal later in time at $t_2$.

The monitoring device 200 may also acquire a reference signal 212 by applying the monitoring signal 206 on the first rail 26 when no train is present in section 46.1, sensing signals on the first rail 26 and using the sensed signals as the reference signal 212. A change in the gradual slope caused by the short 48.1 is more clearly seen in the reference signal 212 at $t_2$.

It is presently believed that a constructive interference of a reflection with the monitoring signal may be indicative of a break in the first rail 26 or the second rail 30. The distance between the break and the device 200 would be calculable in a similar manner as that described above.

It has been found, as illustrated in FIG. 16, that the presence of a train 106 and position of the train on the track 28 may be detected by monitoring the monitoring signal 206 via input 202 on the first rail 26 and a signal 214 via input 17 on the second rail 30. The train's position can be derived from time data relating to when the signal on the first rail converges towards the signal 214 on the second rail.

In FIG. 17, more detail of another example embodiment of the monitoring device, designated 400, is shown. This embodiment is substantially similar to the example embodiment shown in FIG. 4 and like parts are indicated by like reference numerals. This embodiment differs from the embodiment of FIG. 4, as follows: a) the signal generation unit 12 comprises the resistor 66 and parallel capacitor; b) the signal generation unit 12 is configured to launch simultaneously, a first electrical monitoring signal on the first rail 26 and a second electrical monitoring signal on the second rail 30, the second electrical monitoring signal having a different shape than the first electrical monitoring signal; and c) the signal sensing unit 16 comprises an additional pin 164 which is connected to the first port 14, thus the signal sensing unit 16 is sensitive to signals at the first port 14 and at the second port 18 of the device 400. In this embodiment the resistor 66 and parallel capacitor causes a sudden reduction in voltage of the second electrical monitoring signal. The direction of the first and second monitoring signals launched by the device 400 are indicated by arrows A and B respectively. Similarly, as described hereinbefore with reference to FIG. 5, the launched monitoring signals propagate in the first and second rails 26 and 30 and onto the other of the first and second rails 26 (via an electrical connection between the first and second rails, which electrical connection is not shown in FIG. 17) and back to the first and second ports 14 and 18 of the device 400. The directions of derived return signals sensed at the first and second ports 14 and 18 by the signal sensing unit 16 are indicated by arrows C and D respectively. The derived return signals are discussed in more detail below and with reference to FIG. 18.

In FIG. 18, first and second waveforms 402 and 404 of the derived return signals are shown. The first and second waveforms 402 and 404 are measured at the first and second ports 14 and 18 respectively. Although the voltages of both the first and second waveforms 402 and 404 are indicated with positive voltage polarities, in practice one of the voltage polarities is negative. At a time $t_a$ the first and second monitoring signals are launched by the device 400. At a time $t_b$, the first monitoring signal interferes constructively with the second monitoring signal. Similarly, at time $t_b$ the voltage reduction of the second monitoring signal interferes destructively with the first monitoring signal. A time difference $\Delta t$ between time $t_b$ and $t_a$ is used to calculate the distance between the first location and an electrical connection. This embodiment provides independent confirmation of the derived return signals sensed at the first and second ports 14 and 18. This independent confirmation can be used to reduce the effect of noise and false readings. It will be appreciated by a person skilled in the art that the same calculations to determine the distance between the electrical connection and the device 400 can be done when a) at least one of the first and second electrical monitoring signals are off set with a pre-determined DC voltage; or b) the first and second electrical monitoring signals have positive voltage polarities. In case b), the signals will interfere constructively with each other.

In FIG. 19 there is shown another example embodiment of the monitoring system designated 500. In this example embodiment a device 10.1 comprises a single signal generation unit (not shown) and first and second signal sensing units 16.1 and 16.2 which are provided to sense a return signal at first and second spaced locations on a second rail 30. In this embodiment the device 10.1 can determine a direction of propagation of the return signal. With the direction of propagation of the return signal known, the device 10.1 can determine on which side of the device 10.1 an axle 122 of a rail vehicle 124 is present on a section 46.1 of railway track 28. In the example embodiment shown, the monitoring signal is launched on a first rail 26 by the device 10.1. The monitoring signal propagates along the first rail 26, onto the second rail 30 via the axle 122 and along the second rail 30 back to the device 10.1. The return signal is first sensed by signal sensing unit 16.1 and then by signal sensing unit 16.2. Therefore, the device 10.1 can determine that the axle 122 of the rail vehicle 124 is present to the right of the device 10.1 on the section 46.1 of the railway track 28.

The invention claimed is:

1. A monitoring device for a track-bound monitoring system for monitoring conditions on a railway track comprising a first rail and a second rail, the device comprising:

a signal generation unit having an output, the signal generation unit being configured to generate at the output an electrical monitoring signal having a monitoring signal characteristic, the output being electrically connectable to at least one of the first rail and the second rail;

a signal sensing unit having an input, the signal sensing unit being sensitive to signals at the input, the input being electrically connectable to at least one of the first rail and the second rail; and a controller which is connected to the signal generating unit and to the signal sensing unit;

the controller being configured to cause the signal generation unit to generate the monitoring signal which propagates in the first rail and to receive, while the monitoring signal is being generated, from the sensing unit a return signal, the return signal being derived from the monitoring signal and having a return signal characteristic; and the controller further being configured to utilize a time difference between the monitoring signal characteristic and the return signal characteristic to monitor conditions on the railway track.

2. The device of claim 1 wherein the conditions comprise at least one of: occupancy of the railway track by a rail vehicle; position of a rail vehicle on the railway track; position of a rail vehicle axle on the railway track; speed of travel of a railway vehicle on the railway track; direction of travel of a railway vehicle on the railway track; buckling of at least one of the first and second rails; interruption of at least one of the first and second rails; a position of the interruption; a rail weld on at least one of the first and second rails; a position of the rail weld; and a condition of ballast supporting the first and second rails.

3. The device as claimed in claim 1 wherein the device comprises an impedance arrangement which is electrically connectable to the second rail to cause at least one of: a reflection of the electrical monitoring signal propagating on the second rail; and a second electrical monitoring signal to propagate on the second rail.

4. The device as claimed in claim 3 comprising a first port and a second port, wherein the output of the signal generating unit and a first input of the signal sensing unit are connected to the first port and wherein the impedance arrangement is connected to the second port.

5. The device as claimed in claim 4 wherein a second input port of the signal sensing unit is connected to the second port.

6. A track-bound system for monitoring conditions on a railway track comprising a first rail and a second rail, the system comprising:

a device as claimed in claim 1 connected at a first stationary location to the railway track and for launching the monitoring signal in at least one of the first rail and the second rail; and at least one electrical connection between the first rail and the second rail and which is spaced from the first stationary location, the electrical connection, in use, causing the return signal to be passed between the first and second rails, to be monitored at the device.

7. The system as claimed in claim 6 wherein the at least one electrical connection comprises one of: a short; an impedance element; and a network of impedance elements providing an impedance.

8. The system as claimed in claim 6 wherein the at least one electrical connection is permanent and stationary.

9. The system as claimed in claim 6 and wherein the railway track is longitudinally divided into a plurality of immediately adjacent sections each being separated from immediately adjacent sections by spaced first and second permanent boundaries with the first boundary comprising an electrical connection between the first and second rails and the second boundary comprising one of a block joint on at least one of the tracks and an electrical connection between the first and second rails.

10. The system as claimed in claim 9 wherein, for at least one section, more than one device is provided in spaced relation relative to one another, intermediate the first and second boundary.

11. The system as claimed in claim 9 wherein, in at least some of the sections, a second monitoring signal is also launched in one of the first rail and the second rail from one of the first location and a second location which is spaced from the first location.

12. The system as claimed in claim 6 wherein the device comprises an impedance arrangement which is electrically connectable to the second rail to cause a reflection of the electrical monitoring signal propagating on the second rail, to derive the return signal, wherein the input of the signal sensing unit is electrically connected to the first rail and wherein the electrical monitoring signal comprises a pulse having a width at least as long as the time it would take the pulse to propagate from the output, in the first rail, through the at least one electrical connection, in the second rail to the impedance arrangement where it is reflected back in the second rail, through the electrical connection and in the first rail to the input of the signal sensing unit.

13. The device as claimed in claim 1 wherein the device comprises an impedance arrangement which is electrically connectable at a connection point to the second rail forming a voltage divider between the railway track and the impedance arrangement to enable a voltage proportional to leakage currents between the first rail and the second rail to be monitored at the connection point which is connected to the input of the signal sensing unit.

14. The device as claimed in claim 13 wherein the impedance arrangement comprises a resistor and a capacitor in parallel with the resistor connected between the connection point and ground.

15. A method of monitoring conditions on a railway track comprising a first rail, a second rail and a spaced electrical connection provided between the first rail and second rail, the method including the steps of:

causing, from a first location along the railway track, an electrical monitoring signal to propagate in at least one of the first rail and the second rail, the monitoring signal having a monitoring signal characteristic;

sensing on at least one of the first rail and the second rail for a return signal which is derived from the electrical monitoring signal, the return signal having a return signal characteristic; and utilizing a time difference between the monitoring signal characteristic and the return signal characteristic to monitor conditions on the railway track;

wherein the derived return signal comprises the electrical monitoring signal which is transferred from the first rail onto the second rail by the spaced electrical connection and wherein the derived return signal is sensed on at least one of the first rail and the second rail;

wherein the spaced electrical connection is one of a permanent and stationary electrical short, a permanent and stationary impedance arrangement and an axle of a rail vehicle on the railway track; and wherein the monitoring signal comprises a pulse and wherein the time difference between the leading edge of the electrical monitoring signal and a corresponding characteristic of the return signal are used to predetermine a reference round-trip time period it takes the pulse to propagate from the first location, in the first rail to the permanent and stationary electrical short or the permanent and stationary impedance arrangement, through the permanent and stationary electrical short or the permanent and stationary impedance arrangement and in the second rail back to the first location, wherein the monitoring signal characteristic comprises a leading edge of the pulse and the return signal characteristic comprises a corresponding edge in the return signal.

16. The method of claim 15 wherein the conditions comprise at least one of: occupancy of the railway track by a rail vehicle; position of a rail vehicle on the railway track; position of a rail vehicle axle on the railway track; speed of travel of a railway vehicle on the railway track; direction of travel of a railway vehicle on the railway track; buckling of at least one of the first and second rails; interruption of at least one of the first and second rails; a position of the interruption; a rail weld on at least one of the first and second rails; a position of the rail weld; and a condition of ballast supporting the first and second rails.

17. The method as claimed in claim 15 wherein when a first return signal having a first round-trip time shorter than the reference round-trip time is sensed, utilizing the first return signal to determine at least one of the presence of a rail vehicle between the first location and the electrical connection and a distance between the first location and an axle of the rail vehicle.

18. The method as claimed in claim 17 wherein when a second return signal having a second round-trip time which is different from the first round-trip time and shorter than the reference round-trip time is sensed, utilizing the first return signal and the second return signal to determine at least one of direction of travel of the rail vehicle and speed of travel.

19. The method as claimed in claim 18 wherein consecutive detections of a rail vehicle axle moving towards the device in a direction, before moving further away from the device while moving in the same direction are used to detect an individual rail vehicle axle as it moves from one side of the device to the other.

20. The method as claimed in claim 15 including utilizing an impedance arrangement electrically connected to the second rail to cause at least one of a reflection of the monitoring signal on the second rail; and a second electrical monitoring signal to propagate on the second rail.

21. The method as claimed in claim 20 wherein the impedance arrangement is connected to the second rail at the first location.

22. The method as claimed in claim 15 wherein a time difference between a time relating to the monitoring signal characteristic and a time of interference between the monitoring signal and the return signal at the first location is utilized to compute a distance from the first location to the electrical connection.

23. A method of monitoring from a first stationary location along a railway track conditions on the railway track, the railway track comprising a first rail, a second rail and an electrical connection provided between the first rail and second rail at a position spaced from the first stationary location, the method including the steps of:

from the first stationary location, causing an electrical monitoring signal to be generated to propagate in at least one of the first rail and the second rail, the monitoring signal having a monitoring signal characteristic;

at least partially concurrently with the generation, sensing on at least one of the first rail and the second rail for a return signal which is derived from the electrical monitoring signal, the return signal having a return signal characteristic; and utilizing a time difference between the monitoring signal characteristic and the return signal characteristic to monitor conditions on the railway track.

* * * * *